United States Patent [19]

Hamilton et al.

[11] 4,303,969

[45] Dec. 1, 1981

[54] PORTABLE DANCE FLOOR SYSTEM

[76] Inventors: Jerrol D. Hamilton, 5310 W. 21st Ave., Gary, Ind. 46404; Booker T. Hamilton, Jr., 540 Buchanan St., Gary, Ind. 46407

[21] Appl. No.: 148,762

[22] Filed: May 12, 1980

[51] Int. Cl.[3] ..... F21S 1/02

[52] U.S. Cl. ..... 362/153; 362/249; 362/367; 362/806

[58] Field of Search ..... 362/153, 249, 367, 806

[56] References Cited

U.S. PATENT DOCUMENTS 4,120,025 10/1978 Deaven ..... 362/153

*Primary Examiner*—Stephen J. Lechert, Jr.

*Attorney, Agent, or Firm*—Edward D. Gilhooly

[57] ABSTRACT

A portable dance floor having a plurality of modular floor components adapted to be interconnected to form a continuous dance floor. Each of the modular floor components include a self-contained illumination circuitry which is completed upon coupling of the units.

10 Claims, 6 Drawing Figures

FIG. 1
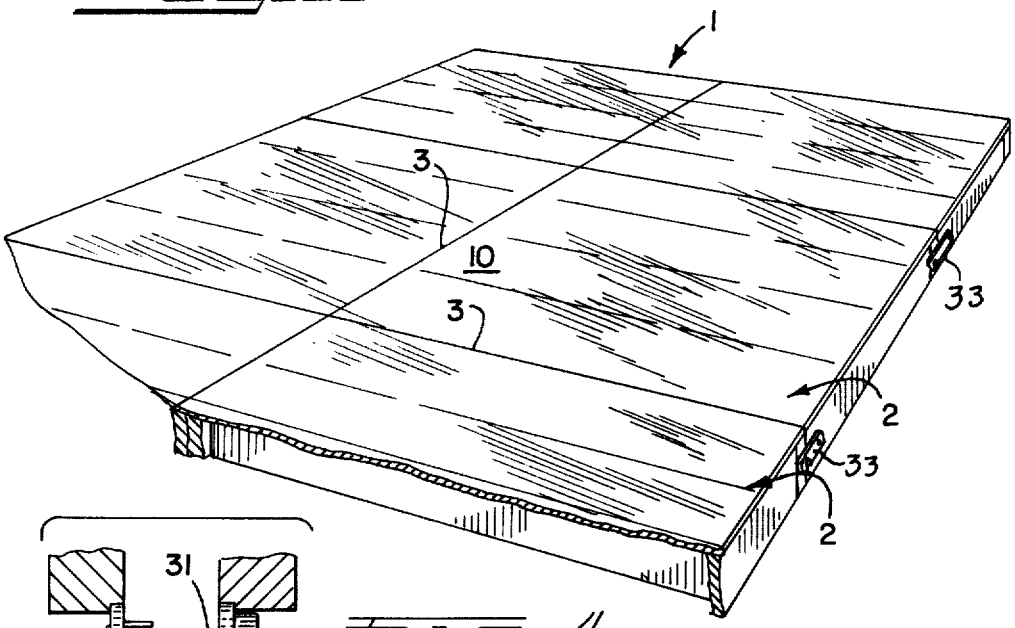
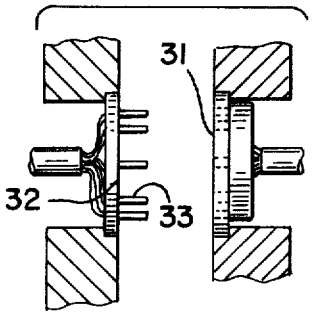
FIG. 4
FIG. 2
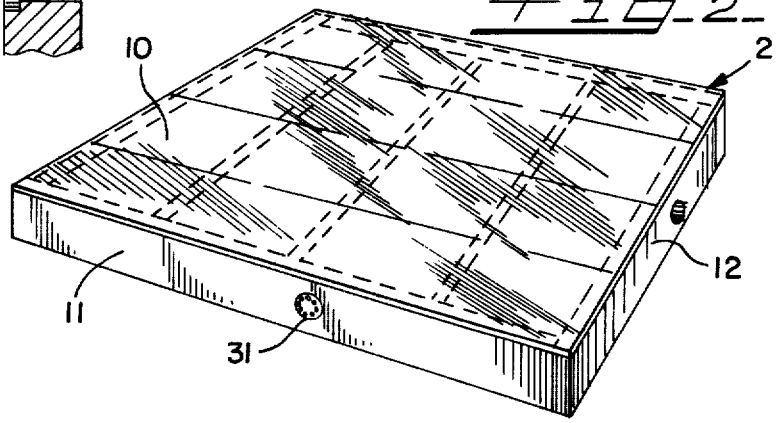
FIG. 3
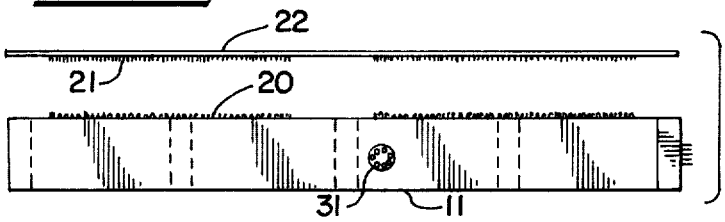

PORTABLE DANCE FLOOR SYSTEM

BACKGROUND OF THE INVENTION

This invention relates in general to a dance floor, and in particular, to a portable dance floor system.

More specifically, but without restriction to the particular use which is shown and described, this invention relates to a portable dance floor system which includes a plurality of modular floor components adapted to be interconnected in a manner to form a continuous dance surface. The system is provided with a self-contained electrical circuitry and illumination means positioned in the modular floor components to create enhance visual effects through the dance surface.

From the earliest time, dancing has been a popular form of entertainment in numerous cultures. In recent years, dance establishments known as discotheques or "discos" have achieved widespread popularity. Generally, such commercial disco dance facilities combine elaborate electronic sound systems with striking visual effects in the form of flashing lights, bright colors, and unique surroundings. The enchanced sensory environment of discotheques contributes to the present popularity of such clubs and the like.

Many commercial nightclubs employ permanently installed dance floors having associated sound systems and visual effects. It is common for various school, church, or social organizations to meet in social gatherings at which dancing is popularly enjoyed. These dances may be held in gymnasiums rooms, or auditoriums that are not equipped with suitable dance facilities. In the past, the dance facilities for such gatherings are merely composed of a floor and a sound system or live musical group. Thus, the temporary employment of an auditorium, gymnasium or other room as a dance facility fails to provide a suitable dance surface along with pleasing visual effects, such as normally found at a commercial discotheque and the like. The participants at such social gatherings are, therefore, deprived of the superior dance facilities that are provided at commercial disco-type environments.

Several attempts have been made in the past to provide a portable-like dance structure, which is capable of being erected at temporary sites. However, the portable dance floors heretofore provided merely employ blocks of material which are interconnected in a manner where no enhancement of the dance environment is attained. Such portable systems in the past also generally require time consuming and laborious assembly and disassembly. Moreover, none of the prior art temporary dance floors provide an effective electrical circuitry to establish a lighting effect which has heretofore been only provided at permanent dance installations. One portable dance floor disclosed in the prior art is described in U.S. Pat. No. 4,120,025 to Deaven issued Oct. 10, 1978. It is, therefore, desirable to provide a portable dance floor system, by which a dancing surface can be economically and quickly erected to provide colorful lighting and flashing effects in conjunction with music.

SUMMARY OF THE INVENTION

It is, therefore, an object of this invention to improve dance floors.

Another object of this invention is to provide a modular dance floor which may be assembled and disassembled on a temporary basis.

A further object of this invention is to provide a temporary dance floor which includes a self-contained lighting system upon erection of the floor.

Still another object of this invention is to enhance the visual effects provided by a temporary dance system.

These and other objects are attained in accordance with the present invention wherein there is provided an improved portable dance floor system having a plurality of modular units which, when interconnected, form a continuous dance surface of superior design. The modularized portable floor system of the invention includes a self-contained lighting system which is automatically and quickly coupled into operative condition during assembly of the dance floor. The invention herein disclosed is provided with an improved manner of coupling the modular units to a floor for use and achieves optimum results over known portable dance systems.

BRIEF DESCRIPTION OF THE DRAWINGS

Further objects of the invention together with additional features contributing thereto and advantages accruing therefrom will be apparent from the following description of the preferred embodiment of the invention which is shown in the accompanying drawings with like reference numerals indicating corresponding parts throughout wherein:

FIG. 1 is a partial perspective view of the modularized portable dance floor system of the invention;

FIG. 2 is a perspective view of a dance module unit of the dance floor system of FIG. 1;

FIG. 3 is an inverted end view of the dance module of FIG. 2 showing its floor mounting;

FIG. 4 is an enlarged exploded view, with parts in section, of the electrical coupling assembly to interconnect adjacent modular units of the dance floor system of FIG. 1;

DESCRIPTION OF THE PREFERRED EMBODIMENT

Figure 5:
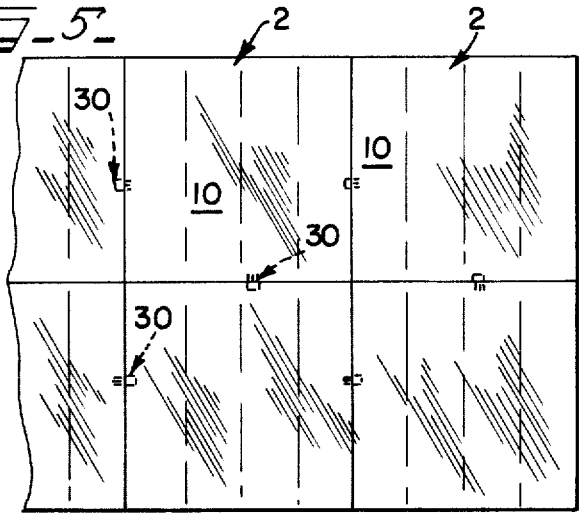
FIG. 5 is a top schematic view of a portion of the dance floor system of FIG. 1.

Referring now to FIG. 1, there is illustrated the modular, portable dance floor system of the invention, generally designated by the reference numeral 1. The dance floor system 1 comprises a plurality of interconnected modular units 2 which together define an upper dance floor surface 1*a*. Any selected number of modular units may be coupled together at interfaces 3 to create the dance floor of a desired surface area.

Figure 6:
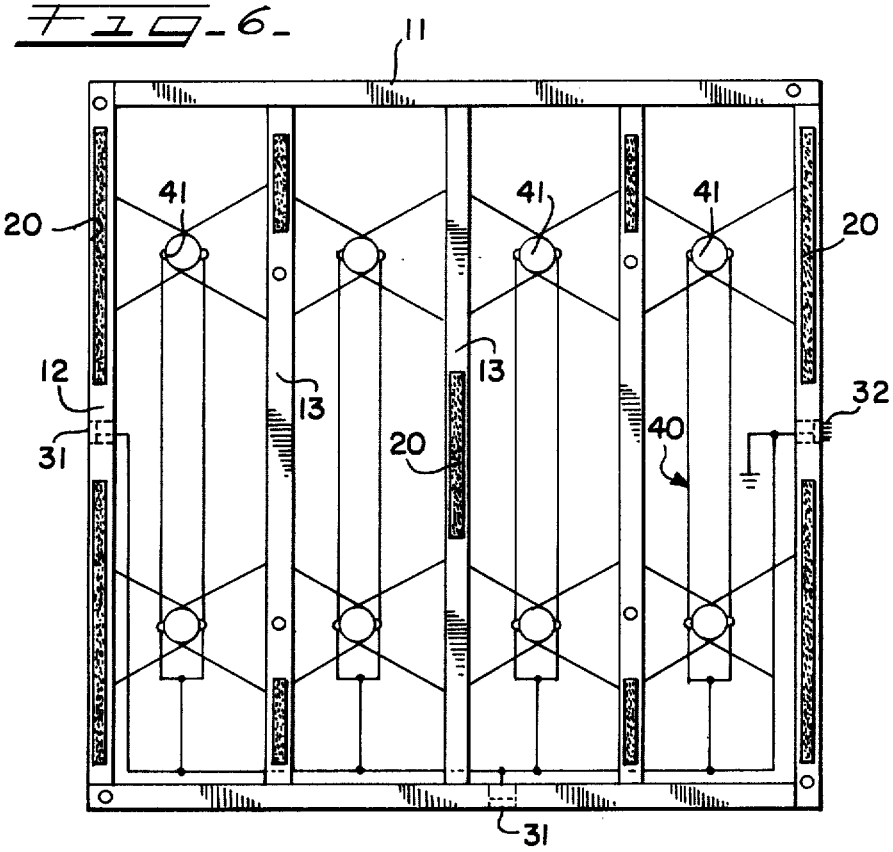
FIG. 6 is a bottom schematic view of a modular unit shown in FIG. 1.

As shown in FIGS. 2, 3 and 6, each of the modular units 2 of the dance floor system 1 includes an upper member 10 in the form of a plate or sheet which is fabricated from any suitable material, such as, for example, plexiglass and the like. The material of upper member 10 may itself be of a selected color, which, if desired, may vary from module to module, to create a distintive pattern forming the dance floor 1*a*. Alternatively, the upper member may comprise a neutral color to be used in conjunction with lights of various colors situated thereunder within the modular units 2 in a manner to be described in detail later.

The upper member 10 is affixed to the upper edge of a plurality of respective opposed pairs of framing members 11 and 12 formed from wood and the like. The framing members 11 and 12 define the cross-sectional configuration of the module 2 and are interconnected to form a square or rectangular modular unit as best shown in FIG. 5. The upper member 10 is affixed to the upper edge of the two pairs of framing members 11 and 12 by suitable threaded elements, adhesives and the like.

As best shown in FIG. 5, the modular unit 2 is strengthened by a plurality of reinforcing, intermediate members 13 which extend between opposite framing members 11 in a substantially parallel relationship to the framing members 12. The bottom edges of framing members 12 and intermediate members 13 are provided with fastener strips 20 that are capable of being attached to complimentary strips 21 carried on a support surface to secure the modules 2 in place. Such fastener strips 20 and 21 may comprise complimentary material capable of temporarily being affixed together in a secured relationship, such as the material sold under the trademark Velcro. As shown in FIG. 3, the material strips 20 of the modular unit 2 may be utilized with corresponding fastener strips 21 which, for example, may be retained upon a flat member 22 in the form of a tarpolin, sheet, or other member. The member 22 may be situated beneath the dance floor system 1 in a temporary relationship on a floor and the like. Thus, as strips 20 of each module 2 are laid into contact with corresponding strips 21 of member 22, the dance floor system 1 is retained in a secured position to permit the use thereof. Other alternative means of attaching the modular units to a support surface or floor (not shown) may be utilized in conjunction with the invention.

Each of the modular units 2 are provided with a self-contained electrical and lighting system which, when the modular units are assembled in the configuration shown in FIG. 1, automatically establishes a suitable electrical circuit to illuminate the lighting elements thereof. The modular units 2 are coupled together by connecting assemblies formed in selected ones of the framing members 11 and 12. The connecting assemblies comprise complimentary female jack receptacles 31 and male receptacles 32 having prongs 33. Although any suitable jack assembly may be employed, one satisfactory means is the male and female socket of a typical vacuum tube. The jack receptacles 31 and 32 of adjacent panels may be interconnected with each other such that an electrical circuitry is completed through dance floor system 1. The coupling of jacks 31 and 32 also increases the physical securement of modular units 2 with each other. Additional securement of the modular units 2 together can be achieved by a latch 33 of a suitable design as shown in FIG. 1. In assembly of the modular units 2 forming a corner or an edge component, the units 2 may only require a female or male jack on two or three sides on framing members 11 or 12, while the center components may require male or female jacks on three or four sides dependent on the circuitry and desired results.

The male and female jacks 31 and 32 are coupled to a suitable electrical circuitry 40 formed within each of the modular units 2 as best shown in FIG. 6. The circuitry 40 includes a plurality of electrical conductors 40*a* that interconnect with a suitable number of electrical lighting fixtures 41 having a female socket (not shown) to receive an illuminating element (not shown) such as a bulb and the like. The fixtures 41 may be supported by a conventional support means (not shown) within each of modular units 2. The illuminating elements of lighting fixtures 41 may comprise an incandescent bulb of desired wattage and selected color to produce an illuminating and color effect through the dance floor depending on the pattern, color and intensity of the light required. A complete electrical circuit between the modular units 2 is automatically established by interconnection of the male jack 32 with an adjacent female jack 31 such that the electrical wiring of the dance floor is not necessary. Thus, the modular units may be assembled and disassembled at a social site with only minimal labor required in the employment of the dance floor system 1. The system 1 may be temporarily erected by being positioned upon the suitable undersurface material 22 for coupling the fasteners strips 20 and 21. A jack at an outer point of one of the modular units 2 may be coupled to a source of electrical power to supply electricity to the internal circuitry 40 created within each of the modular units 2 to illuminate the lighting elements of the fixtures 41. The source of electrical power may be provided with flashing means or the like to create whatever illusionary effect is desired in the system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A portable modular dance floor system comprising a plurality of modular units adapted to be interconnected in a side by side relationship to form a continuous upper surface, said modular units having translucent panels forming said upper surface, coupling means attached to each of said plurality of modular units to interconnect said plurality of modular units, said coupling means of one of said modular units being adapted connected to the coupling means of an adjacent modular units, electrical circuit means operatively positioned in each of said plurality of modular units, said coupling means are adapted to create an electrical circuit between adjacent modular units upon the connection of one of said coupling means to the coupling means of an adjacent modular unit, illumination means coupled to said electrical circuit means, and said illumination means being positioned beneath said translucent panels forming said continuous surface to provide an illuminating effect thereon.

2. The dance floor system according to claim 1 further including securement means coupled to each of said modular units to secure said support surface.

3. The dance floor system according to claim 1 wherein each of said modular units is a modular panel assembly.

4. The dance floor system according to claim 3 wherein said modular panel assembly includes an upper panel to form a portion of said upper surface.

5. The dance floor system according to claim 4 wherein said upper panel is fabricated from a transparent material.

6. The dance floor system according to claim 1 wherein said coupling means includes jack elements.

7. The dance floor system according to claim 4 wherein said modular panel assembly includes a plurality of interconnected frame members surrounding said electrical circuit means.

8. The dance floor system according to claim 7 wherein said frame members include a bottom edge to contact a support surface and an upper edge to support said upper panel.

9. The dance floor system according to claim 8 further comprising panel securement means carried by said bottom edge to secure said modular panel to a support surface.

10. The dance floor assembly according to claim 9 further comprising surface securement means adapted to be supported on the support surface carrying said modular panel, said surface securement adapted to be coupled to said panel securement means to retain said modular panel in place.

* * * * *